US006085352A

United States Patent [19]

Martin

[11] Patent Number: 6,085,352

[45] Date of Patent: Jul. 11, 2000

[54] HOCKEY GOALTENDER'S BLOCKER WITH ARTICULATED BLOCKING PAD

[76] Inventor: Jean-Louis Martin, 983, rue Napoléon, Montréal, Canada, H2L 1C6

[21] Appl. No.: 09/310,951

[22] Filed: May 13, 1999

[51] Int. Cl.[7] ..... A41D 13/08

[52] U.S. Cl. ..... 2/16

[58] Field of Search ..... 2/16, 161.1, 18, 2/22, 24, 44–45, 459, 461–463, 159–160, 267

[56] References Cited

U.S. PATENT DOCUMENTS

| | | | |
|---|---|---|---|
| 3,945,047 | 3/1976 | Jarrell, Jr. | 2/24 |
| 4,068,312 | 1/1978 | Ledesma | 2/24 |
| 4,700,404 | 10/1987 | Lespérance . | |
| 4,999,847 | 3/1991 | Barcelo | 2/24 |
| 5,007,108 | 4/1991 | Laberge et al. | 2/16 |
| 5,107,544 | 4/1992 | Capatosto . | |
| 5,204,993 | 4/1993 | Siemens | 2/44 |
| 5,218,718 | 6/1993 | Chih . | |
| 5,488,739 | 2/1996 | Cardinal | 2/161.1 |
| 5,564,122 | 10/1996 | Wagner . | |
| 5,655,221 | 8/1997 | Worischeck | 2/16 |

*Primary Examiner*—John J. Calvert
*Assistant Examiner*—Tejash Patel
*Attorney, Agent, or Firm*—Robic

[57] ABSTRACT

A goaltender's blocker has an articulated blocking pad made of segments attached to each other by means of hinges. One result of this construction is to allow the lower end of the blocking pad to pivot outwardly when pressed against the playing surface, so as to allow the goaltender to perform the paddle-down maneuver in a comfortable, ergonomically correct and technically sound manner.

2 Claims, 8 Drawing Sheets

HOCKEY GOALTENDER'S BLOCKER WITH ARTICULATED BLOCKING PAD

BACKGROUND OF THE INVENTION a) Field of the Invention

This invention relates to a goaltender's blocker for use in ice hockey, roller hockey, street hockey or any sport where such a blocker is used.

b) Description of the Prior Art

Conventional goaltender's blockers have a generally planar rectangular blocking pad having an outward-facing blocking area to stop or deflect pucks, and an inward-facing back side to which a glove is attached. The blocking pad can be flat, as shown in U.S. Pat. No. 4,700,404, for example; but most recent blocker designs now feature an outwardly-angled upper-end area, as in U.S. Pat. No. 5,564,122, for example.

In all blockers known to the inventor, one or more layers of foam and/or plastic and/or other such material are assembled so as to form a solid and mostly rigid blocking pad.

A particular problem that this invention seeks to solve is that the rigidity of such blocking pads has always created difficulties for goaltenders performing the so-called "paddle-down " maneuver, in which the whole length of the back edge of the stick's paddle is brought into contact with the playing surface. The problem is that the bottom edge of a conventional blocker's rigid blocking pad protrudes by several inches from the glove to which it is attached and thus comes into contact with the playing surface before the stick's paddle does, leaving a gap between the back edge of the paddle and the playing surface where the puck can slide underneath the addle and into the net or within reach of an opponent's stick.

Past attempts at solving this long-standing problem have included goaltenders trying to hold their sticks further out in front of themselves, bending their wrists and pressing down hard in an attempt to bend the blocking pad enough to allow better contact between back edge of paddle and playing surface. This maneuver is usually somewhat uncomfortable, awkward and even painful at times; it is also quite inefficient.

For some time now, goaltenders have intentionally and permanently deformed the blocking pad of their blocker, bending and twisting it into whatever shape they felt would offer the least resistance and allow the easiest contact between the paddle and the playing surface. Manufacturers now produce and sell blocker models in which the usual rigid, one-piece blocking pads are already bent, curved and otherwise distorted to the same end.

Such compromise solutions, however, result in a permanently distorted and poorly balanced blocking pad in which the protective qualities and the effective height and/or width of the lower-end blocking area are reduced, as compared to those of an intact flat-padded blocker.

SUMMARY OF THE INVENTION

The present invention provides an improvement in a hockey goaltender's blocker of the type including a glove and a generally rectangular blocking pad, said blocking-pad having a bottom edge, an outward-facing, generally planar blocking surface to stop or deflect pucks and an inward-facing back side to which said glove is attached. The invention provides the improvement wherein the blocking pad has a lower-end segment and an upper-end segment, and the lower-end segment is articulated by means of a resilient hinge device. In this manner the lower-end segment pivots outwardly relative to the upper-end segment when pressure is applied to the bottom edge, quickly returns to its original position as soon as said pressure is removed, and retains its full rigidity when pressure is applied inwardly to the blocking surface.

Preferably, the resilient hinge device comprises an elastic member having one extremity attached to the back side of the upper-end segment of the blocking pad, and another extremity attached to the back side of the lower-end segment of said blocking pad.

In accordance with a preferred embodiment of the invention, the blocking pad is divided into segments attached together by means of hinges which allow the segments to pivot outwardly when outside pressure is applied to their bottom edge, as is the case in the paddle-down maneuver, for example. This outward-pivoting action of the blocker's articulated lower-end segments allows complete unobstructed contact between the whole length of the back edge of the paddle and the playing surface. In addition, the hinged segments are equipped with a spring, an elastic band or any other similar tension device that will cause each lower-end segment to quickly return to its initial planar position as soon as pressure is removed. The articulations are also designed in such a way that any lower-end segment can only pivot outwardly, away from the goaltender, but cannot be made to pivot inwardly, toward the goaltender, even when pressure is applied inwardly to the outward-facing blocking side, as when the blocking pad is used to stop or deflect a fast-travelling puck, for example. As is now conventional, the outer shell of the new blocker is made of synthetic leather-like material; one difference is that it features elasticized-material inserts at hinge points to allow for the outward pivoting motion of the lower-end segments.

Further features and advantages of the invention will be described or will become apparent in the course of the following detailed description.

BRIEF DESCRIPTION OF THE DRAWINGS

In order that the invention may be more clearly understood, a preferred embodiment thereof will now be described in detail by way of example, with reference to the accompanying drawings, in which.

DESCRIPTION OF A PREFERRED EMBODIMENT OF THE INVENTION

Figure 1:
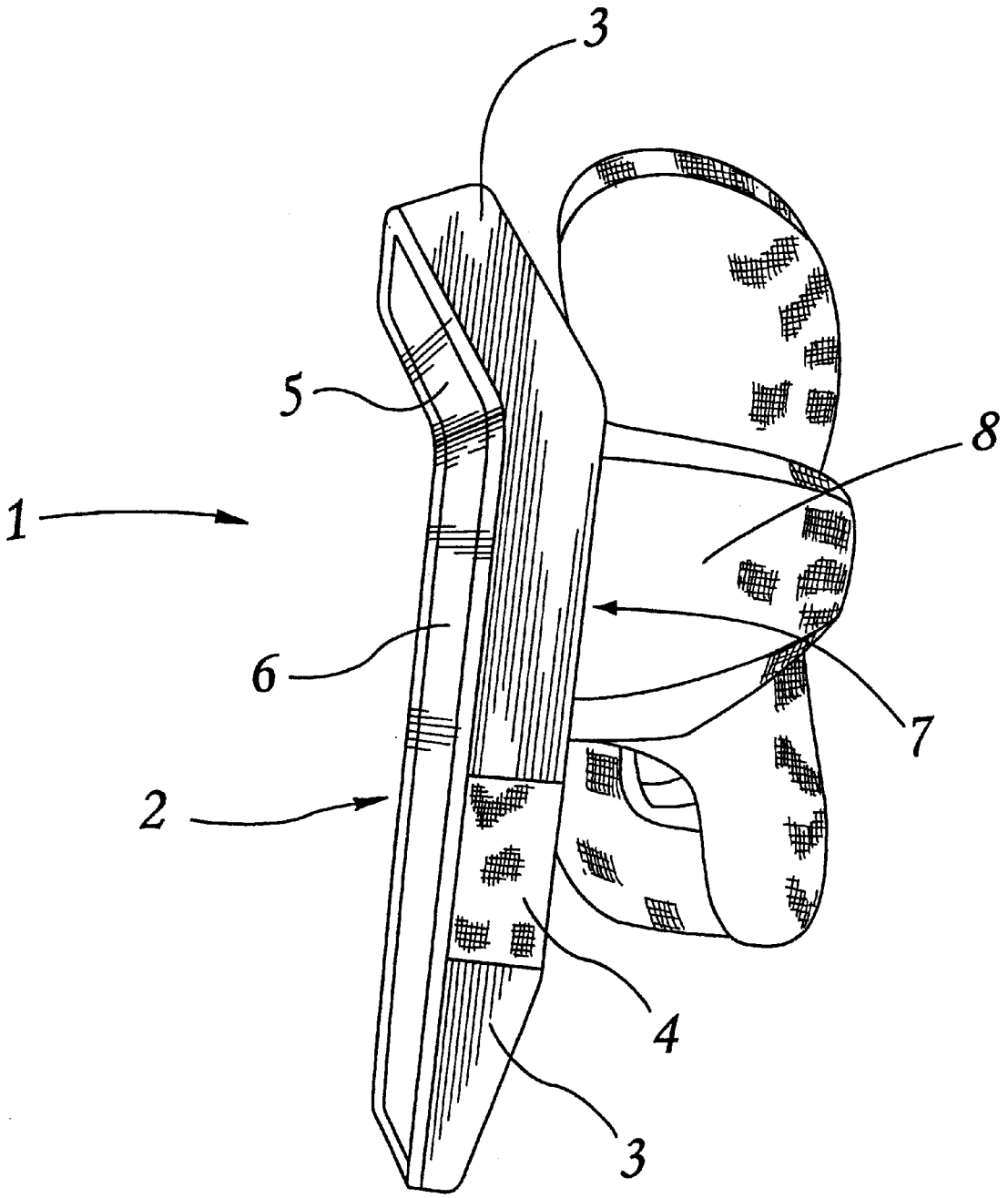
FIG. 1 is a perspective view, looking toward the inside edge, showing the blocker's basic components.

Referring to the drawings, a preferred embodiment of the invention will now be described in greater detail.

As can readily be seen from FIG. 1, the blocker 1 has a blocking pad 2 that can be of any convenient shape but is shown here as a rectangle of varying thickness, wrapped in an outer shell 3 made of synthetic-leather material with elasticized-material inserts 4. The blocking pad has a top-end area 5 that angles outwardly from the substantially planar puck-deflection area 6, and is mounted by way of its inward surface 7 on the back of a glove 8 which can vary greatly in shape, style or protective features.

Figure 2:
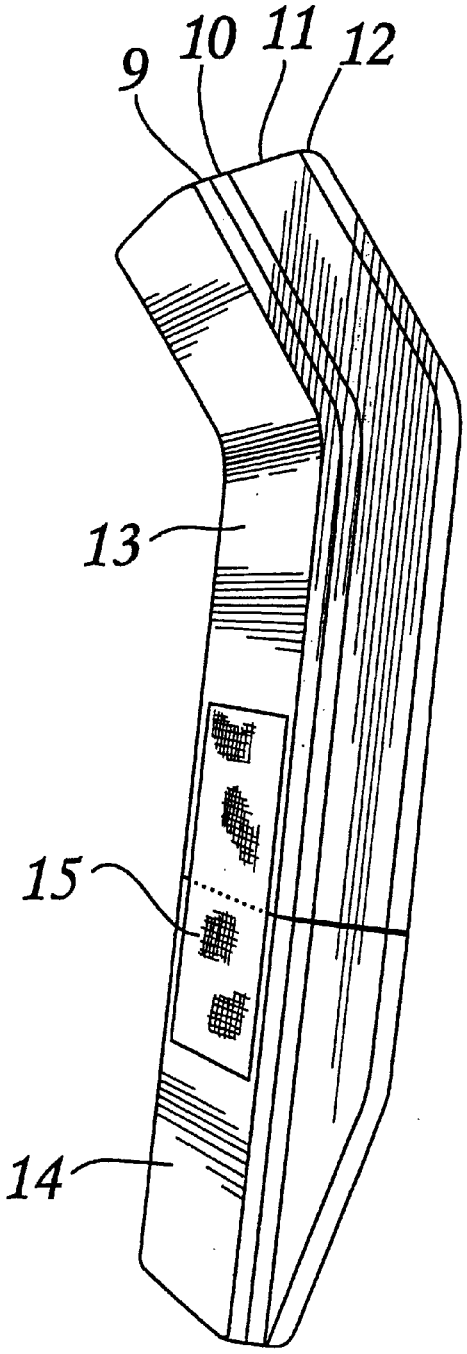
FIG. 2 is a view similar to FIG. 1, where the outer shell and the padded glove have been removed to reveal the blocking pad composed of two segments held together by a hinge.

In FIG. 2, the outer shell and the glove of the blocker have been removed and we see how the blocking pad, as is now conventional, is made of several layers 9, 10, 11, and 12 of synthetic resin foam of varying densities and thicknesses, bonded together or otherwise assembled so as to form a pad that is solid and capable of absorbing and dissipating the shock of a hockey puck impacting it at speeds that sometimes exceed 100 mph. However, instead of being in one rigid piece, the blocker here presents a blocking pad consisting of two articulated segments: an upper-end segment 13, and a lower-end segment 14 attached to segment 13 by means of a hinge 15 in such a way as to allow lower-end segment 14 to pivot outwardly relative to upper-end segment 13 . In the present view, segments 13 and 14 are shown in their relatively flat planar alignment, which is the position they assume initially, when the system is at rest.

The capacity of segment 14 to pivot outwardly relative to segment 13 can be achieved via a great number of different types of hinges, scorings or other similar articulation devices or systems. There can also be numerous possibilities with regard to the number of hinged segments used, their configuration and their placement.

Figure 3:
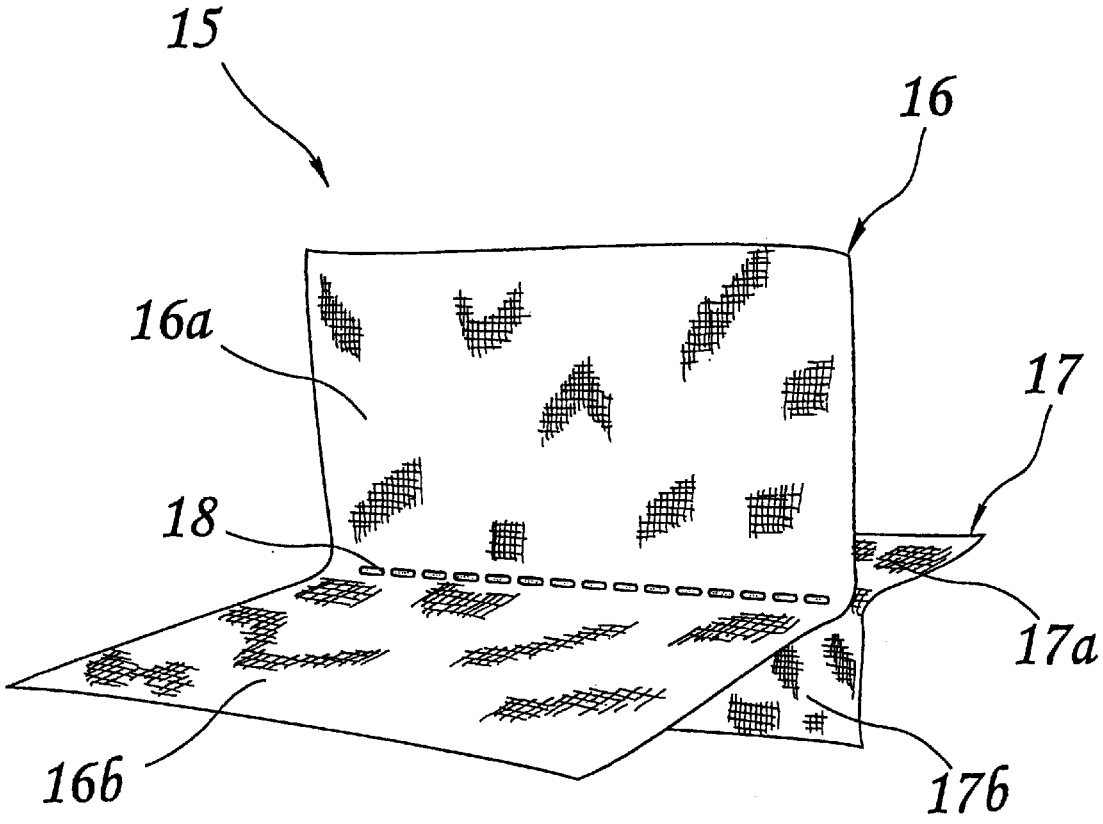
FIG. 3 is a perspective view showing the hinge made of two rectangles of pliable low-stretch material stitched together.

In FIG. 3 we see how in the present embodiment hinge 15 is made from two pieces 16 and 17 of sturdy, low-stretch material such as KEVLAR (trademark), for instance, held together across their middle sections by a stitch 18, so as to determine four flaps 16*a*, 16*b*, 17*a* and 17*b*.

Figure 4:
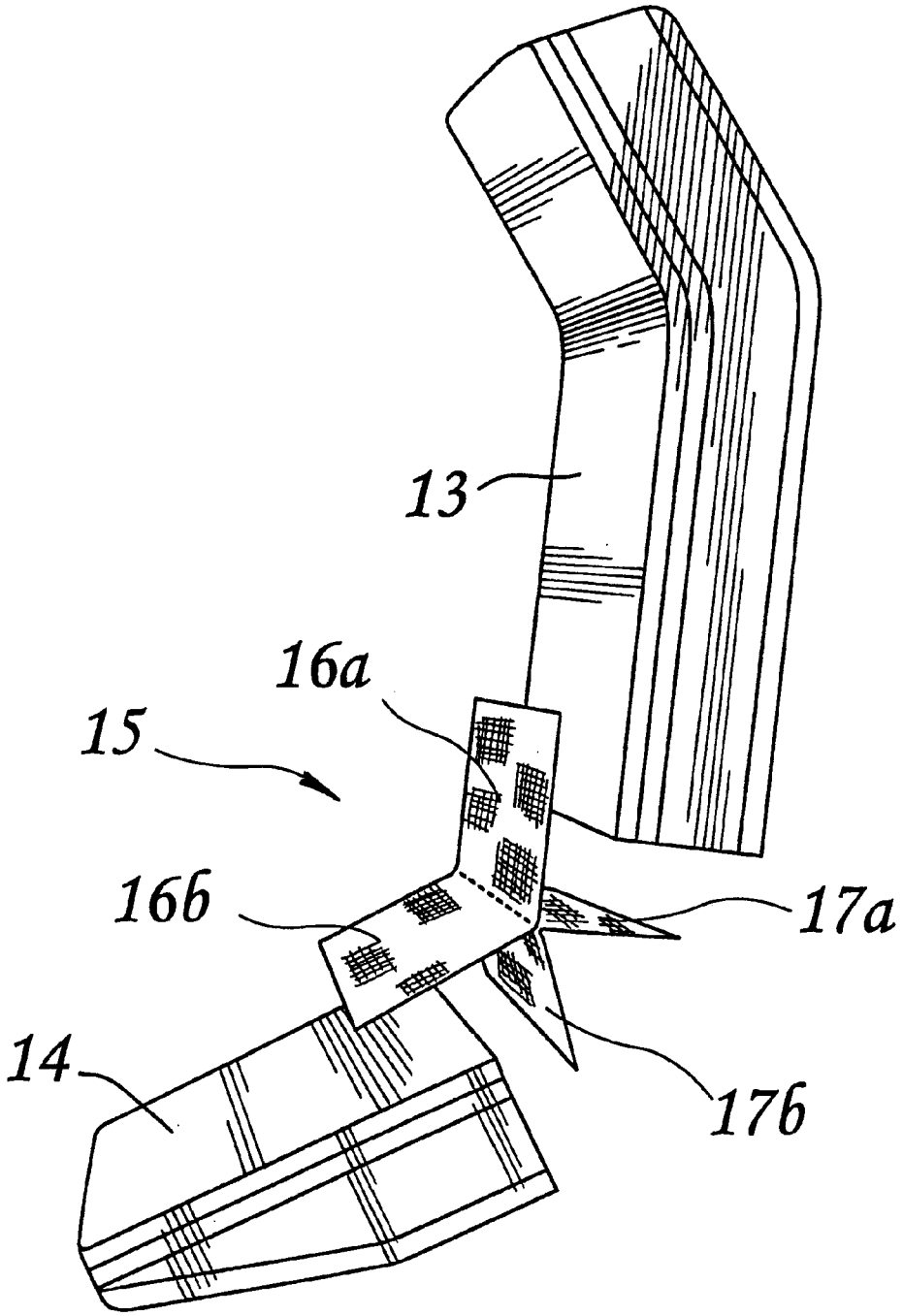
FIG. 4 is an exploded view showing how the hinge is positioned relative to the blocking-pad segments.

FIG. 4 shows the position of hinge 15 and its four flaps 16*a*, 16*b*, 17*a* and 17*b* relative to lower-end segment 14 and upper-end segment 13.

Figure 5:
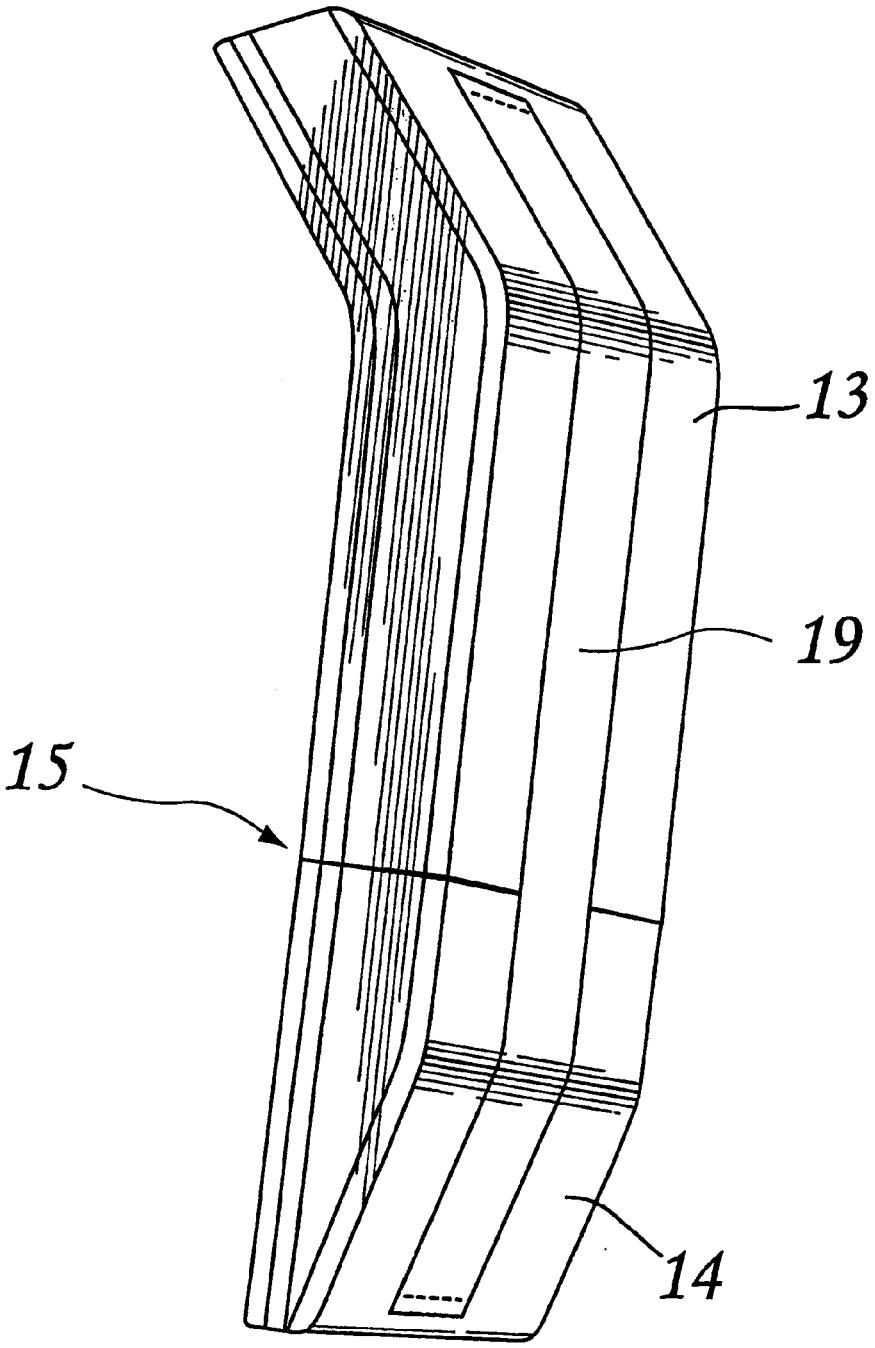
FIG. 5 is a perspective view of the back of the blocking pad, showing the elastic member that acts as a tension device.

In FIG. 5 we see the back side of the blocking pad with upper-end segment 13 and lower-end segment 14 held together by hinge 15. An elastic band 19 has one extremity attached to the back side of lower-end segment 14, and another extremity attached to the back side of upper-end segment 13. The elastic band is attached under sufficient tension so as to pull lower-end segment 14 firmly against upper-end segment 13 and to hold both segments in a substantially flat planar alignment when the system is at rest and no outside pressure is applied.

Figure 6:
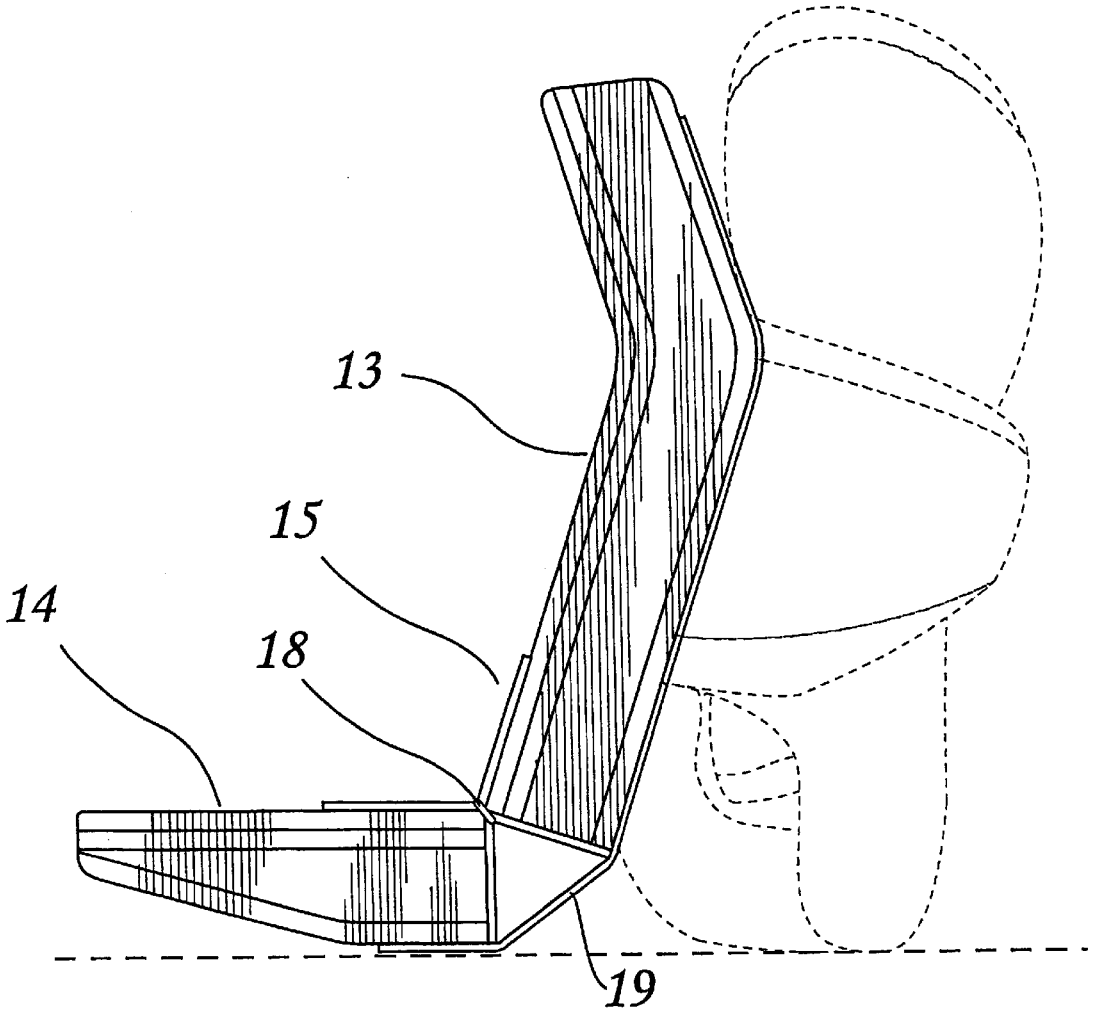
FIG. 6 is a side view of the blocking pad, showing the lower-end segment pivoted outwardly relative to the upper-end segment.

FIG. 6 is a side view showing that when lower-end segment 14 comes under outside pressure, as happens when the goaltender performs a paddle-down maneuver, elastic member 19 is stretched by the increased pivoting of lower-end segment 14 relative to upper-end segment 13 and thus acts as a tension device that will pull lower-end segment 14 back toward its initial at-rest planar position of FIG. 5 relative to upper-end segment 13 when outside pressure is removed.

Figure 7:
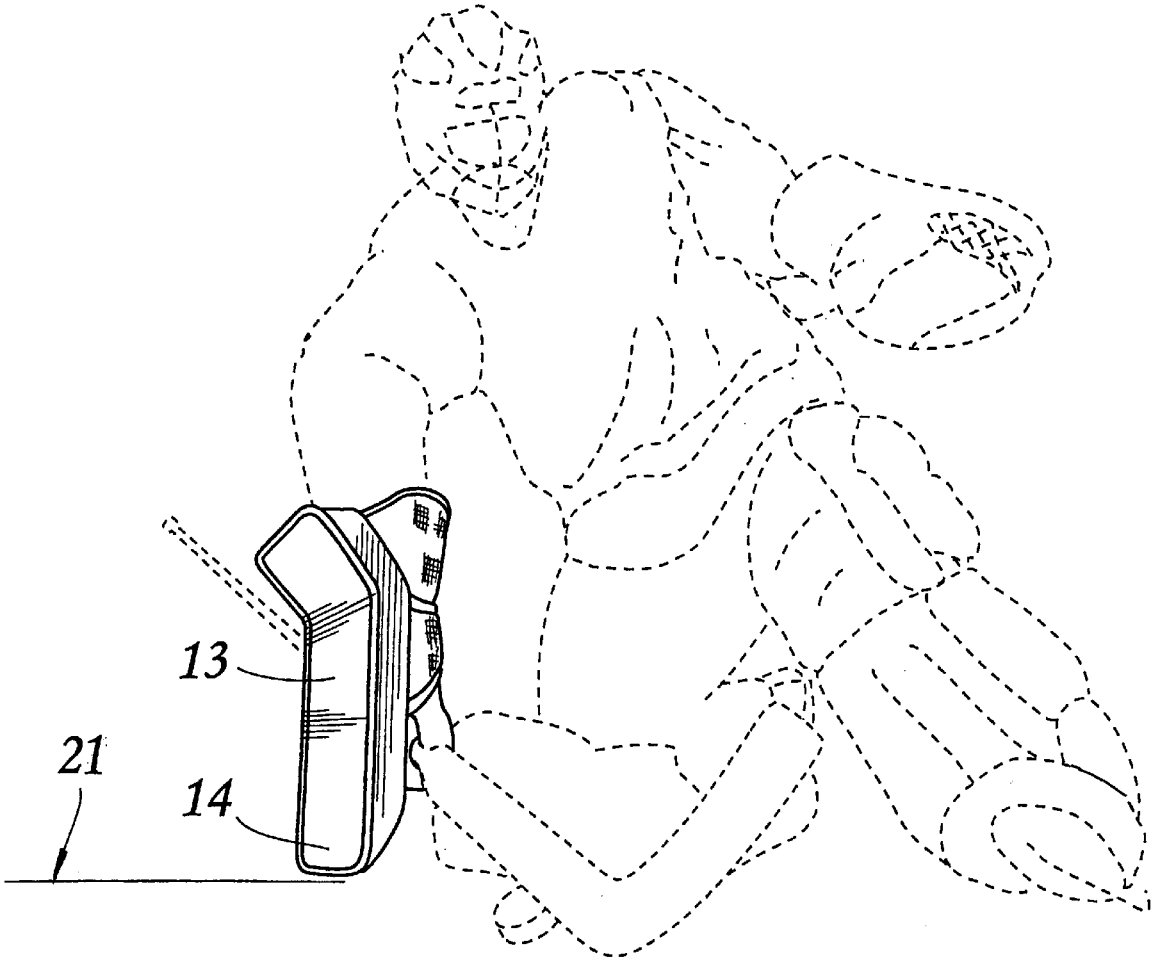
FIG. 7 is a perspective view showing the goaltender initiating a paddle-down maneuver, with the blocker's lower-end segment just touching the playing surface.

In FIG. 7, the goaltender is initiating a paddle-down maneuver; the bottom edge of lower-end segment 14 has just come into contact with a playing surface 21 and the segments composing his blocking pad are still in their flat, at-rest planar alignment. At this point, the rigid blocking pad of a conventional blocker would resist further downward pressure, preventing any further motion of the stick or the glove toward the playing surface, thus leaving a sizeable gap between the back edge of the paddle and the playing surface where the puck could slide underneath the paddle and into the net or within reach of an opponent's stick.

Figure 8:
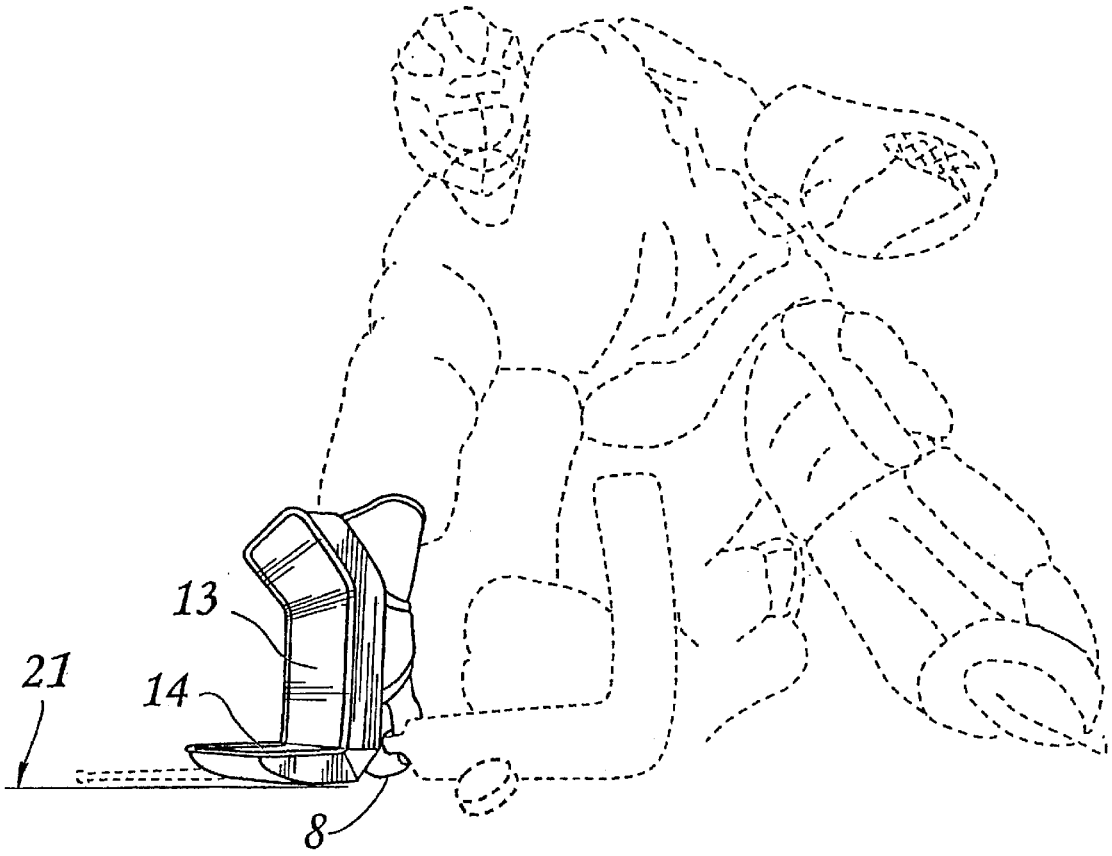
FIG. 8 is a view similar to FIG. 7, but where the goaltender has completed the paddle-down maneuver, with the lower-end segment pivoted outwardly relative to the upper-end segment.

In FIG. 8, We see how, with the blocker of this invention, as soon as more downward pressure is exerted, the lower-end segment gives way, pivoting outwardly relative to the upper-end segment, allowing close contact of the glove and the back edge of the paddle with the playing surface, closing the gap seen in FIG. 7 and allowing the goaltender to make the save. This position also provides the goaltender excellent support from his fist inside glove 8 resting squarely against the playing surface, enabling him to retain or regain his balance or to quickly push himself back up to his feet.

It will be appreciated that the above description relates to the preferred embodiment by way of example only, and that various changes and modifications may be effected therein by one skilled in the art without departing from the spirit or the scope of the present invention as defined in the appended claims, whether or not expressly described herein.

What is claimed is:

1. In a hockey goaltender's blocker including a glove and a generally rectangular blocking pad, said blocking-pad having a bottom edge, an outward-facing, generally planar blocking surface to stop or deflect pucks and an inward-facing back side to which said glove is attached, the improvement wherein:

the blocking pad has a lower-end segment and an upper-end segment, the lower-end segment having a resilient hinge articulation means so as to pivot outwardly relative to the upper-end segment when pressure is applied to the bottom edge, to quickly return to the unpivoted position as soon as said pressure is removed, and to retain full rigidity when pressure is applied inwardly to the blocking surface.

2. A hockey goaltender's blocker according to claim 1, wherein the resilient hinge device comprises an elastic member having one extremity attached to the back side of the upper-end segment of the blocking pad and another extremity attached to the back side of the lower-end segment of said blocking pad.

* * * * *